US007269378B2

(12) United States Patent
Baek et al.

(10) Patent No.: US 7,269,378 B2
(45) Date of Patent: Sep. 11, 2007

(54) TRANSFER UNIT MOUNTING DEVICE AND IMAGE FORMING APPARATUS HAVING THE SAME

(75) Inventors: Chung-guk Baek, Suwon-si (KR); Yong-back Yoo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 108 days.

(21) Appl. No.: 10/856,757

(22) Filed: Jun. 1, 2004

(65) Prior Publication Data

US 2005/0084290 A1 Apr. 21, 2005

(30) Foreign Application Priority Data

Oct. 17, 2003 (KR) ..... 10-2003-0072424

(51) Int. Cl.
*G03G 21/16* (2006.01)

(52) U.S. Cl. ..... 399/121

(58) Field of Classification Search ..... 399/66, 399/107, 110, 113, 121, 297
See application file for complete search history.

(56) References Cited

U.S. PATENT DOCUMENTS 5,175,589 A * 12/1992 Kimura ..... 399/297
5,371,575 A * 12/1994 Sekino et al. ..... 399/25
2004/0009008 A1* 1/2004 Park et al. ..... 399/116
2005/0002687 A1* 1/2005 Jung et al. ..... 399/110

FOREIGN PATENT DOCUMENTS

| | | | |
|---|---|---|---|
| JP | 05-173379 | | 7/1993 |
| JP | 06130839 | A * | 5/1994 |
| JP | 07-168453 | | 7/1995 |
| JP | 08-101623 | | 4/1996 |
| JP | 11-180260 | | 7/1999 |
| JP | 2003-084647 | | 3/2003 |
| JP | 2003-233290 | | 8/2003 |
| KR | 96-38344 | | 12/1996 |
| KR | 2001-4136 | A | 1/2001 |
| KR | 01-0026180 | | 6/2001 |
| KR | 2003-50912 | A | 6/2003 |

OTHER PUBLICATIONS

Korean Official Action issued on Jul. 26, 2005, for Korean Patent Application No.: 2003-72424 (listing 2 references).
Japanese Office Action dated Mar. 27, 2007 issued in JP 2004-265447.

* cited by examiner

*Primary Examiner*—David M. Gray
*Assistant Examiner*—Ryan Gleitz
(74) *Attorney, Agent, or Firm*—Stanzione & Kim, LLP

(57) ABSTRACT

A transfer unit mounting device of an image forming apparatus to mount and dismount a transfer unit in and from the image forming apparatus. The transfer unit includes a transfer belt driven by a plurality of rollers, and a housing to protect the transfer belt. The transfer unit mounting device includes at least one damping unit to elastically support the transfer unit to prevent a shock from being transferred to the transfer unit when the transfer unit is mounted.

45 Claims, 9 Drawing Sheets

TRANSFER UNIT MOUNTING DEVICE AND IMAGE FORMING APPARATUS HAVING THE SAME

CROSS-REFERENCE TO RELATED APPLICATIONS

This application claims the benefit of Korean Patent Application No. 2003-72424, filed on Oct. 17, 2003, in the Korean Intellectual Property Office, the disclosure of which is incorporated herein by reference.

BACKGROUND OF THE INVENTION

1. Field of the Invention

The present general inventive concept relates to a transfer unit mounting device to removably mount a transfer unit in an image forming apparatus, and more particularly, to a transfer unit mounting device which enables easy mounting of a transfer unit in a printer body and is capable of mitigating an impact on the transfer unit during mounting, and an image forming apparatus having the same.

2. Description of the Related Art

Generally, an image forming apparatus, such as a printer or a photocopier, includes a developing unit to form an image to be printed, and a transfer unit to transfer the image formed on the developing unit onto a printing medium such as paper.

The developing unit and the transfer unit are disposed in a body of the image forming apparatus and operate in close association with each other. The developing unit and the transfer unit are periodically replaced with new ones because image quality deteriorates as a predetermined time passes.

The developing unit and the transfer unit are mounted or dismounted from the image forming apparatus when a maintenance process, such as repair, is required. A mounting device is provided for a user to perform a series of mounting and dismounting operations with convenience.

FIGS. 1 and 2 are schematic views showing a conventional transfer unit mounting device. Referring to FIGS. 1 and 2, the conventional transfer unit mounting device includes a first guide rail 12, a second guide rail 14, a first and a second guide protrusions 22 and 24, and a first and a second handles 32 and 34.

The first and the second guide rails 12 and 14 are disposed on opposite sides of a frame (not shown) of a body of an image forming apparatus, and recesses 16 and 18 are formed on the first and second guide rails 12 and 14, respectively.

The first and the second guide protrusions 22 and 24 are formed on opposite sides of a transfer unit 10. The first guide protrusion 22 is inserted in the recess 16 of the first guide rail 12 disposed on the frame, and the second guide protrusion 24 is inserted in the recess 18 of the second guide rail 14.

The first handle 32 is formed on one side of the transfer unit 10 and is shaped in various ways for a user grip. The second handle 34 is formed on an upper surface of the transfer unit 10. A locking lever 40, a photosensitive unit 50, and guide rails 62 and 64 for guiding the photosensitive unit 50 are also provided.

Referring to FIG. 2, the operation of the conventional transfer unit mounting device with the above construction is described below.

In order to mount the transfer unit 10, a user holds the second handle 34 with one hand, holds the first handle 32 with the other hand, and places one end of the first and the second guide protrusions 22 and 24 on the respective recesses 16 and 18 of the first and the second guide rails 12 and 14 formed on the frame (not shown) of the body.

The user frees the second handle 34 and concurrently pushes a portion around the first handle 32 in a direction of B of FIG. 2 so that the first and the second guide protrusions 22 and 24 of the transfer unit 10 are slidably inserted in the recesses 16 and 18 of the first and the second guide rails 12 and 14, respectively.

In order to draw out the transfer unit 10 from the body of the image forming apparatus, a user grabs the first handle 32 with one hand and withdraws the transfer unit 10. When the second handle 34 is drawn out from the body, the user grabs the second handle 34 with the other free hand and pulls the transfer unit 10 in a direction of A. The first and the second guide protrusions 22 and 23 slide out along the recesses 16 and 18 of the first and the second guide rails 12 and 14, respectively. Accordingly, the user has to make sure that the second handle 34 is held by the user hand when the second handle 34 is exposed outside, to prevent the transfer unit 10 from falling down to a floor from the image forming apparatus.

While the conventional transfer unit mounting device with the above construction requires for a user to hold the second handle 34 when the transfer unit 20 is drawn out from the body by slidaby moving along the guide rails of the side surfaces of the body frame (not shown), there was a high possibility that the user drops down the transfer unit 10 to the floor. Additionally, there was no fixing means to securely fix the transfer unit 10 after the transfer unit 10 is mounted, the transfer unit 10 is easily trembled or deviated even by weak vibration.

Yet another problem is that the first and the second guide protrusions 22 and 24 collide with the first and the second guide rails 12 and 14 of the body frame when the transfer unit 10 is mounted, and the shock from the collision is directly transferred to the transfer unit 10, causing the disorder (breakdown) of the transfer unit 10 or shortening a lifespan of the transfer unit 10.

The first and the second guide rails 12 and 14 or the first and the second guide protrusions 22 and 24 may be also deformed or bent. As a result, a gap between the transfer unit and the developing unit is often changed, causing a severe defect of a printing quality.

SUMMARY OF THE INVENTION

In order to solve the above and/or other problems it is an aspect of the present general inventive concept to provide a transfer unit mounting device of an image forming apparatus with which a user can mount and dismount a transfer unit in and from the image forming apparatus with ease, and which is capable of maintaining a substantially constant gap between the transfer unit and a developing unit.

It is another aspect of the present general inventive concept to provide a transfer unit mounting device of an image forming apparatus which is capable of mitigating an impact exerted on the transfer unit and caused by collision of the transfer unit with a developing unit or a weight of the transfer unit.

Additional aspects and advantages of the present general inventive concept will be set forth in part in the description which follows and, in part, will be obvious from the description, or may be learned by practice of the general inventive concept.

The above and/or other aspects of the present general inventive concept are achieved by providing a transfer unit mounting device of an image forming apparatus, in which a transfer unit is mounted in and dismounted from the image forming apparatus. The transfer unit may include a transfer belt driven by a plurality of rollers, and a housing to protect the transfer belt. The transfer unit mounting device may include at least one damping unit to elastically support the transfer unit to prevent a shock from being transferred to the transfer unit when the transfer unit is mounted.

According to an aspect of the present general inventive concept, the damping unit may include at least one housing protrusion disposed on the housing of the transfer unit and a damper assembly disposed on a developing unit of the image forming apparatus to buffer and support a weight of the transfer unit when the damper assembly becomes in contact with the housing protrusion.

According to another aspect of the present general inventive concept, the damping unit may include at least one housing protrusion disposed on a photoconductive unit of the image forming apparatus and a damper assembly disposed on the transfer unit to buffer and support a weight of the transfer unit when the damper assembly becomes in contact with the housing protrusion.

According to yet another aspect of the present general inventive concept, the damping unit may include at least two damper assemblies respectively disposed on the housing and the developing unit of the image forming apparatus.

According to still another aspect of the present general inventive concept, the damper assembly may include an elastic member, a buffer bar elastically movable by the elastic member in a vertical direction, and a supporting member to enclose and support the elastic member and the buffer bar.

According to still another aspect of the present general inventive concept, the transfer unit mounting device may further include a gap ring to maintain substantially a constant gap between the transfer belt and a photosensitive drum on which an image to be printed is formed.

According to yet another aspect of the present general inventive concept, the transfer unit mounting device may further include at least one guide protrusion disposed on the transfer unit and at least one guide rail disposed in a body of the image forming apparatus to guide the guide protrusion.

According to yet another aspect of the present general inventive concept, the guide protrusion may include at least one first guide protrusion and at least one second guide protrusion, and the guide rail may include at least one first guide rail and at least one second guide rail. The transfer unit mounting device may further include a locking unit to secure the first and the second guide protrusions in a secured position so that the first and second guide protrusions cannot be moved or released from the secured position.

According to another aspect of the present general inventive concept, the locking unit may include a rotary lever to secure the first guide protrusion, a rotary cam to secure the developing unit, a connection bar to connect the rotary lever and the rotary cam so that the rotary lever and rotary cam can move in relation to each other, and an interference lever to limit a movement of the second guide protrusion.

The above and/or other aspects of the present general inventive concept, are also achieved by providing an image forming apparatus that may include a paper feeding device to convey paper, a photoconductive unit where an image is formed through a light scanning procedure and a developing procedure, a transfer unit to transfer the image formed on the developing unit to a printing medium, a fusing unit to affix a toner onto the printing medium, and a transfer unit mounting device having at least one damping unit to mitigate a shock to the transfer unit.

According to an aspect of the present general inventive concept, the transfer unit mounting device may further include a gap ring to maintain a substantially a constant gap between the transfer unit and the developing unit.

According to another aspect of the present general inventive concept, the damping unit may include at least one housing protrusion disposed on a housing of the transfer unit or the photoconductive unit and a damper assembly to buffer and support a weight of the transfer unit when the transfer unit becomes in contact with the photoconductive unit. The damper assembly may include an elastic member, a buffer bar elastically movable by the elastic member in a vertical direction, and a supporting member to enclose and support the elastic member and the buffer bar.

According to yet another aspect of the present general inventive concept, the image forming apparatus may further include at least one guide protrusion disposed on the transfer unit and at least one guide rail disposed on a body of the image forming apparatus to guide the guide protrusion. The image forming apparatus may further include a locking unit to secure the guide protrusion in a secured position so that the first and second guide protrusions cannot be moved or released from the secured position.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
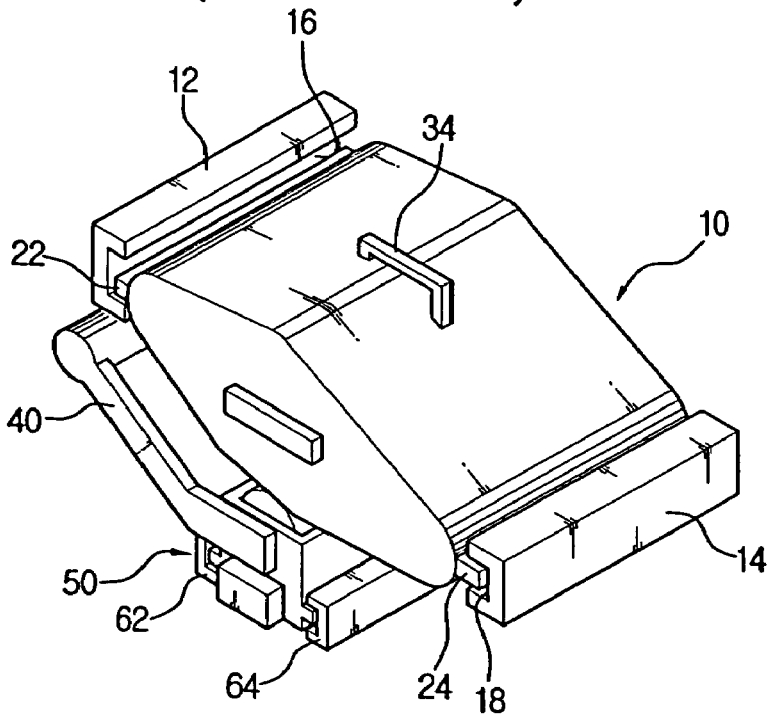
FIG. 1 (PRIOR ART)
FIG. 1 is a schematic view showing a conventional transfer unit mounting device.
Figure 2:
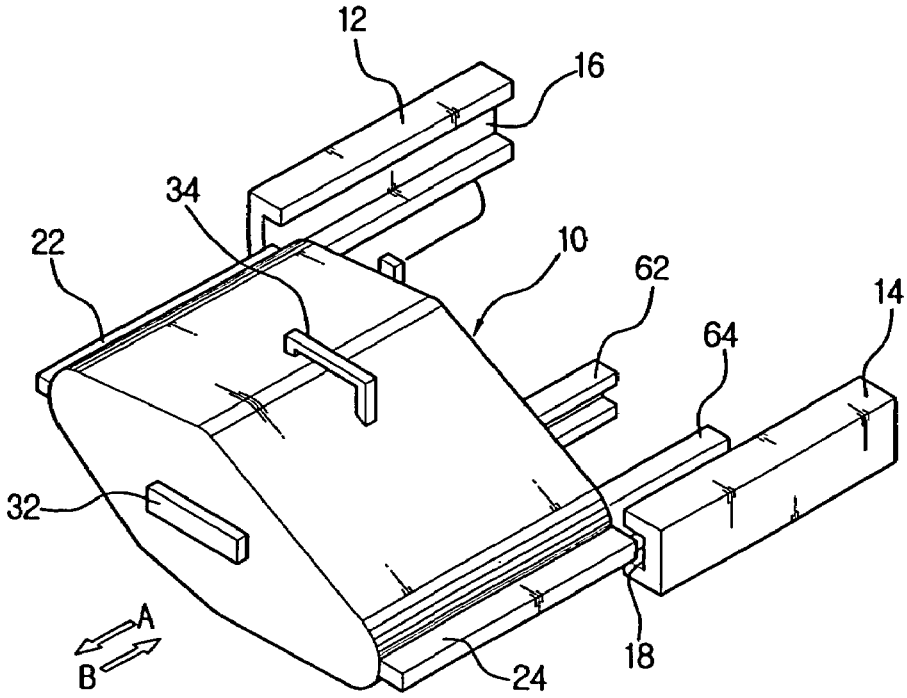
FIG. 2 (PRIOR ART)
FIG. 2 is a schematic view showing an operation of the transfer unit mounting device as shown in FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
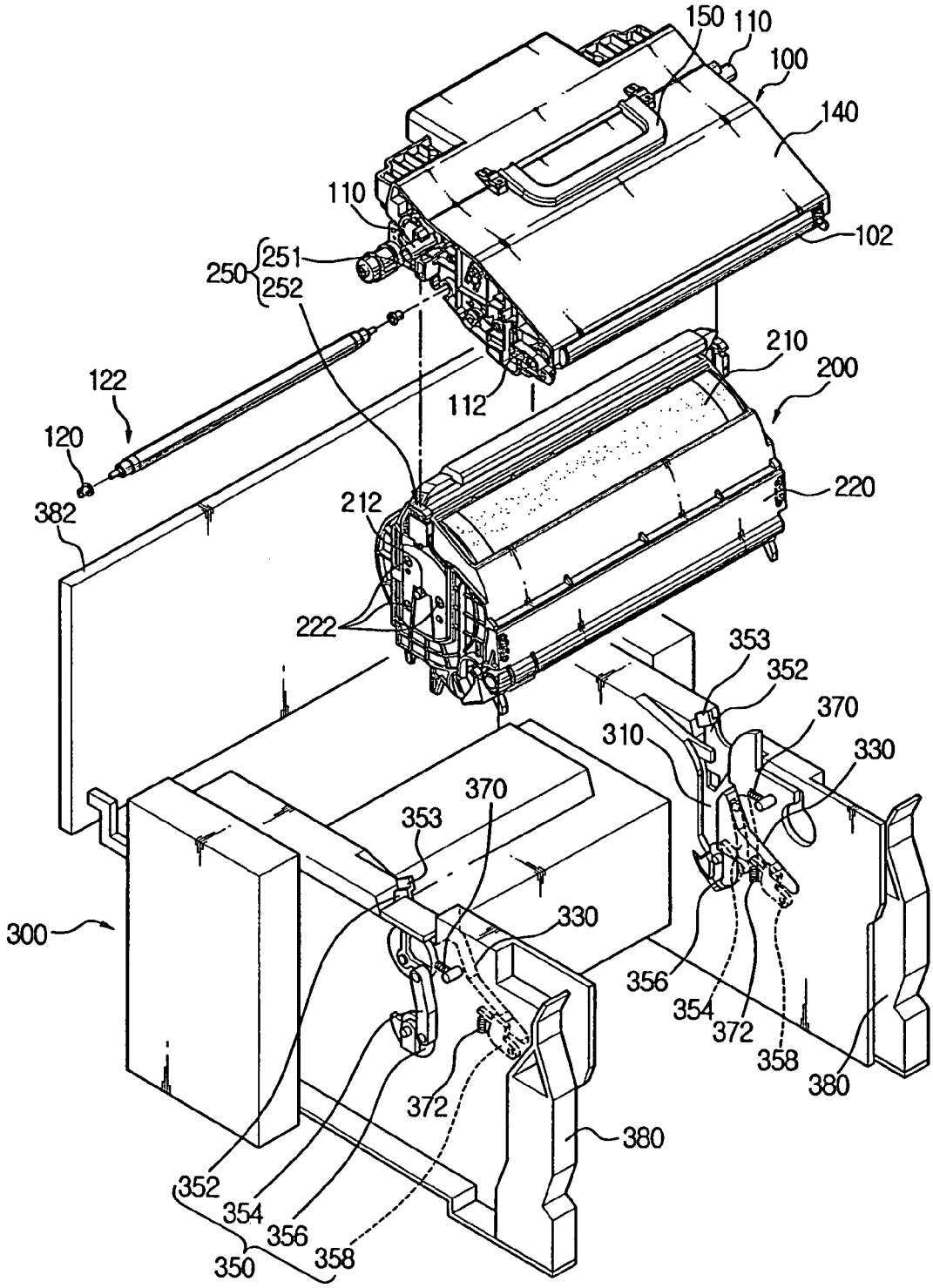
FIG. 3 is a perspective view showing a transfer unit mounting device according to an embodiment of the present general inventive concept.
Figure 4:
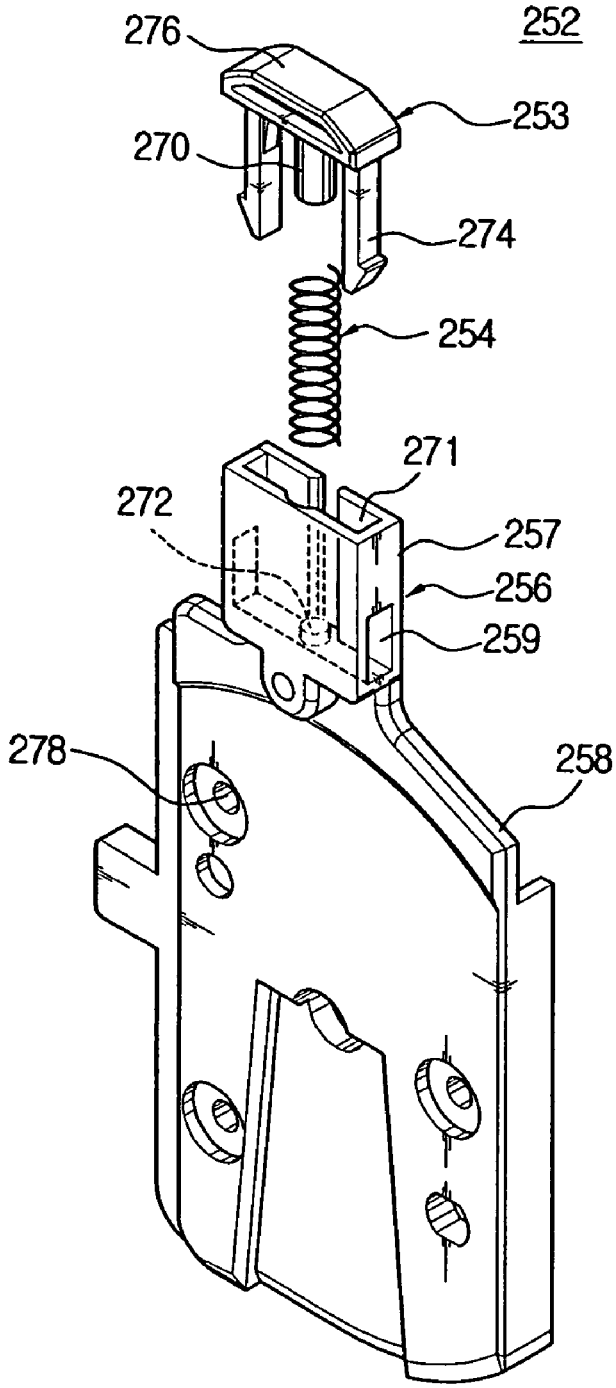
FIG. 4 is an exploded perspective view showing a damper assembly of the transfer unit mounting device as shown in FIG. 3.
Figure 5:
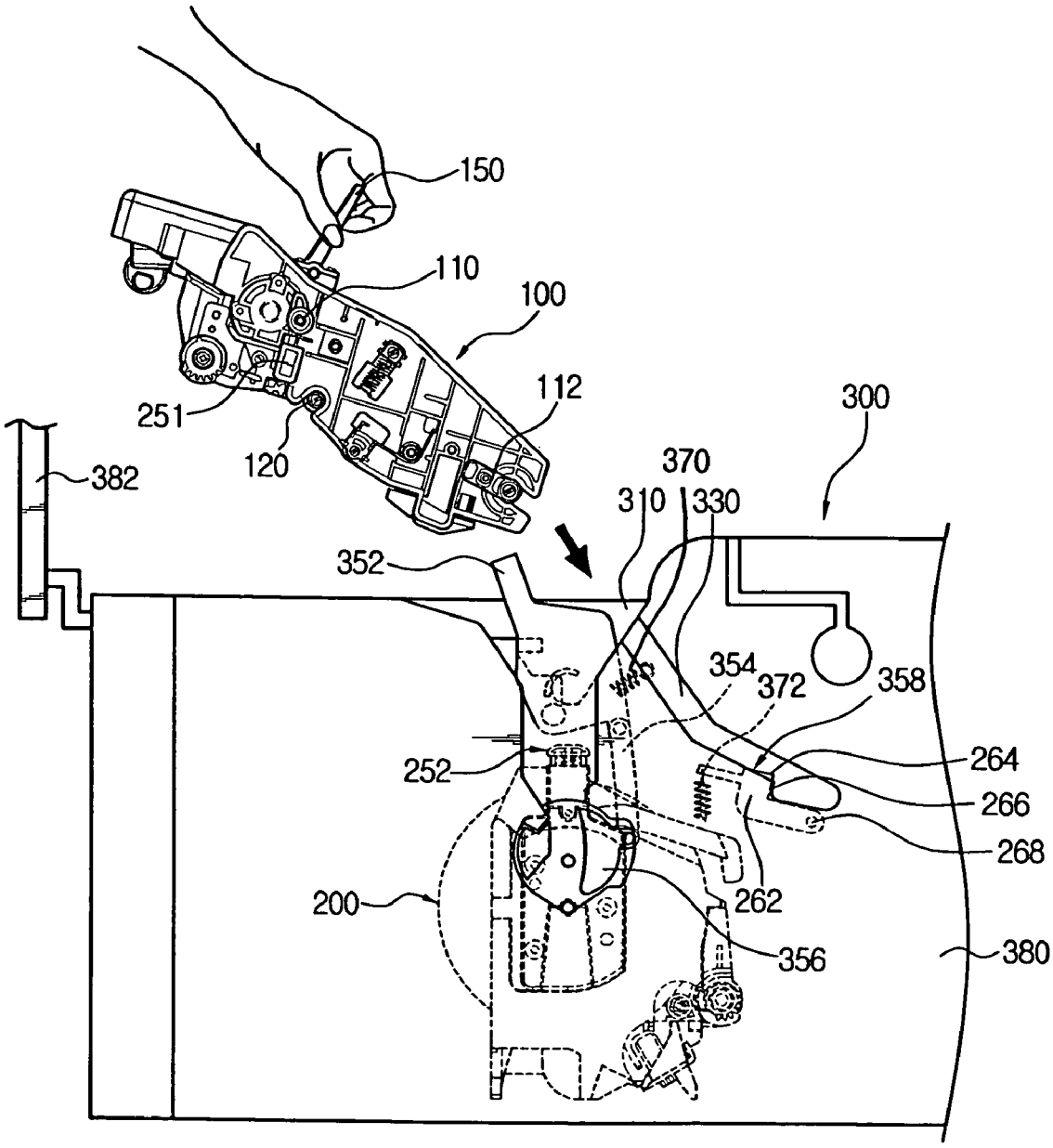
FIG. 5 is a partial cross-sectional view showing the transfer unit mounting device as shown in FIG. 3, in which a body cover is opened to mount the transfer unit after a developing unit is mounted.

FIG. 3 is a perspective view of a transfer unit mounting device according to an embodiment of the present general inventive concept. Referring to FIG. 3, the transfer unit mounting device may include a transfer unit 100, a developing unit 200 and a body 300, FIG. 4 is an enlarged view showing a damper assembly 252 of the transfer unit mounting device of FIG. 3, and FIG. 5 is a partial cross-sectional view showing the body 300 of the image forming apparatus and the transfer unit 100 as shown in FIG. 3. The developing unit 200 may be referred to a photoconductive unit having a photoconductive (photosensitive) drum on which an image is formed and on which the formed image is developed with a developer. The transfer unit 100 can receive the developed image from the photoconductive (photosensitive) drum of the developing (photoconductive) unit 200. The received image is transferred to a sheet of paper from the transfer unit 100.

The transfer unit mounting device according to an embodiment of the present general inventive concept will be described in greater detail later with reference to FIGS. 3 to 5.

Referring to FIG. 3, the transfer unit mounting device may include a first guide protrusion 110, a second guide protrusion 112, a gap ring 120, a damping unit 250, a first guide rail 310, a second guide rail 330, and a locking unit 350.

Two first guide protrusions 110 can be formed (provided) on opposite sides of the transfer unit 100, and two second guide protrusions 112 can be formed (provided) on opposite sides of the transfer unit 100. The first guide protrusions 110 are disposed on both ends of a shaft of a cleaning backup roller (not shown) while the second guide protrusions 112 are formed on both ends of a shaft of a driving roller 102. In an aspect of the present general inventive concept, the first and the second guide protrusions 110 and 112 can be disposed on both ends of the shafts of the cleaning backup roller and the driving roller 102, respectively. In another aspect of the present general inventive concept, the first and the second guide protrusions 110 and 112 may be disposed on a housing 140 and other rollers of the transfer unit 100, such as a transfer roller (not shown) or a tension roller (not shown). The transfer unit 100 may also include a handle 150.

The gap ring 120 can maintain substantially a constant gap between a transfer belt (not shown) of the transfer unit 100 and a photosensitive drum 210 of the developing unit 200 when the transfer unit 100 is mounted in the image forming apparatus. The gap between the photosensitive drum 210 and the transfer belt (not shown) can be an important factor to determine an image transfer efficiency of the image forming apparatus. In this embodiment, gap rings 120 can be mounted on both side surfaces of a nip roller 122 of the transfer unit 100. The gap ring 120 may have an outer diameter which is large enough to protrude from a lower end surface of the transfer belt (not shown) when mounted, such that the gap ring 120 can stay in contact with the photosensitive drum 210 when the transfer unit 100 is mounted in the image forming apparatus to maintain substantially the constant gap between the photosensitive drum 210 and the transfer belt (not shown). Although the gap ring 120 is disposed on the nip roller 122 in this embodiment, the present general inventive concept is not limited thereto. The gap ring 120 can be disposed on one of other rollers of the transfer unit 100.

The damping unit 250 can operate to mitigate an impact exerted on the transfer unit 100 and caused by collision of the transfer unit 100 with the developing unit 220 when the transfer unit 100 is mounted on an upper end of the developing unit 200. As shown in FIG. 3, the damping unit 250 may include a housing protrusion 251 and a damper assembly 252. The housing protrusion 251 can protrude from the housing 140 of the transfer unit 100, and the damper assembly 252 can be secured to opposite ends of a housing 220 of the developing unit 200 by a plurality of screws 222.

Referring to FIG. 4, the damper assembly 252 may include a buffer bar 253, an elastic member 254, and a supporting member 256. The buffer bar 253 can directly contact the housing protrusion 251 and can protrude from a top of the damper assembly 252. The elastic member 254, such as a coil spring, can be disposed on a lower part of the buffer bar 253 to absorb a shock exerted on the buffer bar 253 from the transfer unit 100 or the developing unit 200. The supporting member 256 can receive the buffer bar 253 and the elastic member 254 and can be secured to the housing 220 of the developing unit 200 by a plurality of screws.

The damping unit 250 with the above construction can be disposed on opposite sides of the housing 222 of the developing unit 200. Accordingly, the elastic member 254 can be disposed between the buffer bar 253 and the supporting member 256 to absorb the shock caused by a weight of the transfer unit 100 when the housing protrusion 251 of the transfer unit 100 contact the buffer bar 253 as the transfer unit 100 is mounted in the image forming apparatus. The buffer bar 253 can be provided with a plurality of hooks 274 and a first protrusion 270 formed on a lower end thereof and may have an upper end 276 to be pressed when being in contact with the housing protrusion 251. The supporting member 256 may include an inserting part 257 and a fixing part 258. The elastic member 254 can be inserted in the inserting part 257, and the inserting part 257 can be provided with a second protrusion 272 formed therein and a plurality of openings 259 formed on both sides thereof.

The buffer bar 253 can be inserted into the supporting member 256 through an opening 271 to be connected to the supporting member 256 in a manner that the plurality of hooks 274 are hooked into the supporting member 256 through the plurality of openings 259. Also, the elastic member 254 can be guided by the first and the second protrusions 270 and 272 to be stably positioned between the buffer bar 253 and the supporting member 256. The fixing part 258 of the supporting member 256 may have a plurality of screw holes 278 formed thereon to fixedly couple the damper assembly 252 to the housing 220 of the developing unit 200. The damper assembly 252 may be disposed on the transfer unit 100. Although the damper assembly 252 has the buffer bar 253, the elastic member 254, and the supporting member 256 as shown in FIG. 4, the present general inventive concept is not limited thereto. Various types of damper assemblies can be used as the damper assembly 252 to absorb a force exerted on the transfer unit 100, the developing unit 200, or the body 300.

The first and the second guide rails 310 and 330 can be formed inside frames 380 which are disposed on both sides of the body 300 of the image forming apparatus as shown in FIGS. 3 and 5. The first guide rail 310 can be formed in substantially in a vertical direction while the second guide rail 330 can be formed substantially in an oblique direction of the frame 380. That is, the first and the second guide rails 310 and 330 can be formed on an inside of respective ones of the frames 380 disposed on the both sides of the body 300 of the image forming apparatus in a symmetrical manner. The first and the second guide protrusions 110 and 112 of the transfer unit 100 can be slidably inserted into the first and the second guide rails 310 and 330, respectively. The first and second guide rails 310 and 330 may have a common entrance through which the first and second guide protrusions 110 and 112 are inserted into the first and second guide rails 310 and 330, respectively.

As shown in FIGS. 3 and 5, the locking unit 350 may include a rotary lever 352, a rotary cam 356, a connection bar 354, and an interference lever 358. The locking unit 350 can be disposed on the frames 380 disposed on both sides of the body 300 of the image forming apparatus. The rotary lever 352 and the rotary cam 352 can rotatably hinge on the frame 380, and the connection bar 354 can hinge on the rotary lever 352 and the rotary cam 352 on opposite ends thereof. The interference lever 358 can protrude a little bit toward the second guide rail 330 to prevent the second guide protrusion 112 from being released from a mounting state. The locking unit 350 as constructed above can be operated in a manner such that, when the transfer unit 100 is mounted in the image forming apparatus and a rotary lever handle 353 is rotated, the connection bar 354 moves downwardly to rotate the rotary cam 356. In association with this operation, a cover 355 of FIG. 7, disposed on the rotary lever 352, rotates to fix the first guide protrusion 110, and the rotary cam 356 fixes a drum shaft 212 of the developing unit 200.

As shown in FIG. 5, the interference lever 358 may include a fixed end 268 and a free end 262. The free end 262 may have an inclined first surface 264 and a stepped second surface 266. The inclined first surface 264 can be inclined to allow the second guide protrusion 112 to smoothly slide along the first surface 264 of the free end 262 when the second guide protrusion 112 slides on the second guide rail 330 downwardly, and the stepped second surface 266 can prevent the second guide protrusion 112 from ascending in a reverse direction. Accordingly, no interference occurs between the first surface 264 and the second guide protrusion 112 when the second guide protrusion 112 slides downward along the first surface 264 of the free end 262. Once the transfer unit 100 is mounted, the transfer unit 100 can be interfered by being blocked by the stepped second surface 266.

In order to separate the transfer unit 100 from the image forming apparatus, a user can lift the second guide protrusion 112 of the transfer unit 100 a little bit from the second guide rail 330 and then pull out the second guide protrusion 112 along the second guide rail 330. The interference lever 358 can be provided to prevent damage on the transfer unit 100 and the photosensitive drum 210, the damage occurring due to a friction between the photosensitive drum 210 and the transfer belt (not shown) when the transfer unit 100 is pulled out from the image forming apparatus in which the photosensitive drum 210 and the transfer belt (not shown) contact each other. Due to the presence of the interference lever 358 as a protection device, the transfer unit 100 can be pulled out from the image forming apparatus only after the developing unit 200 and the transfer unit are separated from each other by the slight lifting of the second guide protrusion 112 of the transfer unit 100. A reference numeral 382 of FIG. 3 indicates a body cover of the image forming apparatus, reference numerals 370 and 372 indicate springs disposed on sides of the rotary lever 358 and the interference lever 353 to elastically bias the rotary lever 358 and the interference lever 353 in an unlocking direction, and a reference numeral 150 indicates a handle.

Hereinafter, operations of the transfer unit mounting device of the image forming apparatus with the above construction according to embodiments of the present general inventive concept will be described with reference to FIGS. 5 to 8.

Figure 6:
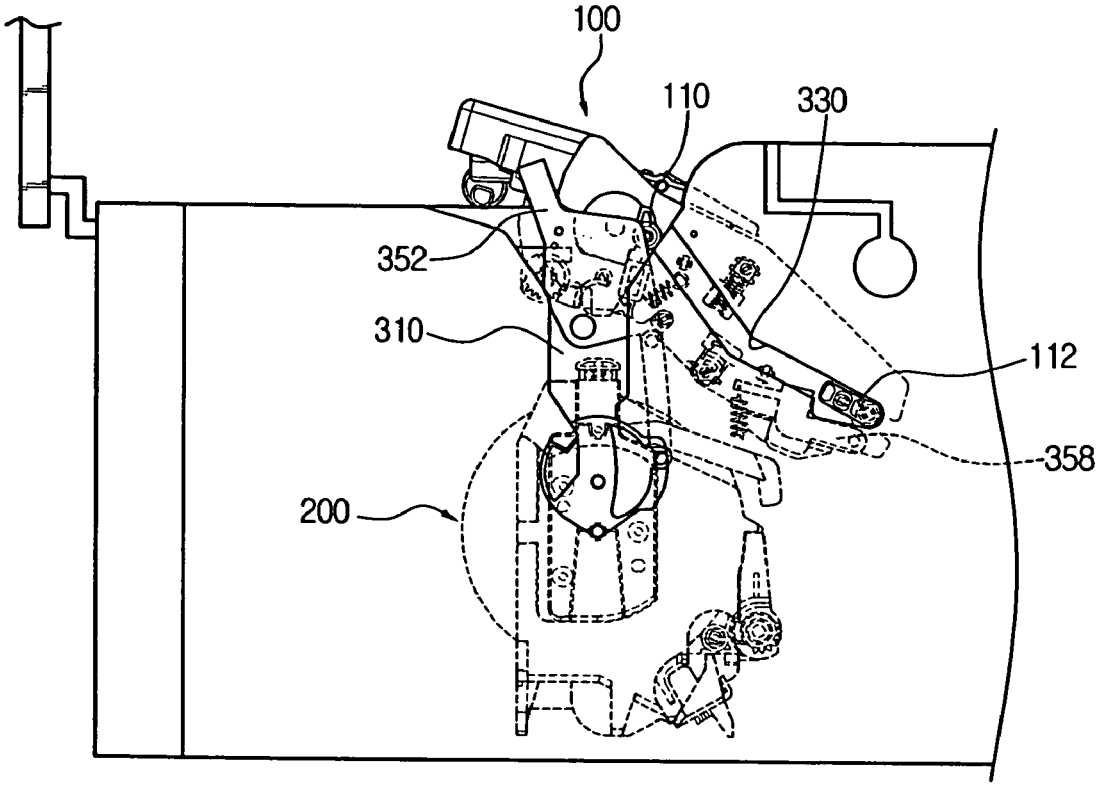
FIG. 6 is a partial cross-sectional view showing the transfer unit mounting device as shown in FIG. 3, in which a second guide protrusion is placed on a second guide rail.

In order to mount the transfer unit 100 in the image forming apparatus, as shown in FIG. 5, a user opens the body cover 382 of the image forming apparatus, holds the handle 150 of the transfer unit 100 with one hand, inserts the second guide protrusions 112 of the transfer unit 100 into the second guide rails 330 through the common entrance and pushes the transfer unit 100 to a mounting position. The second guide protrusion 112 can slide along the second guide rail 330 and enters into the mounting position as shown in FIG. 6.

Figure 7:
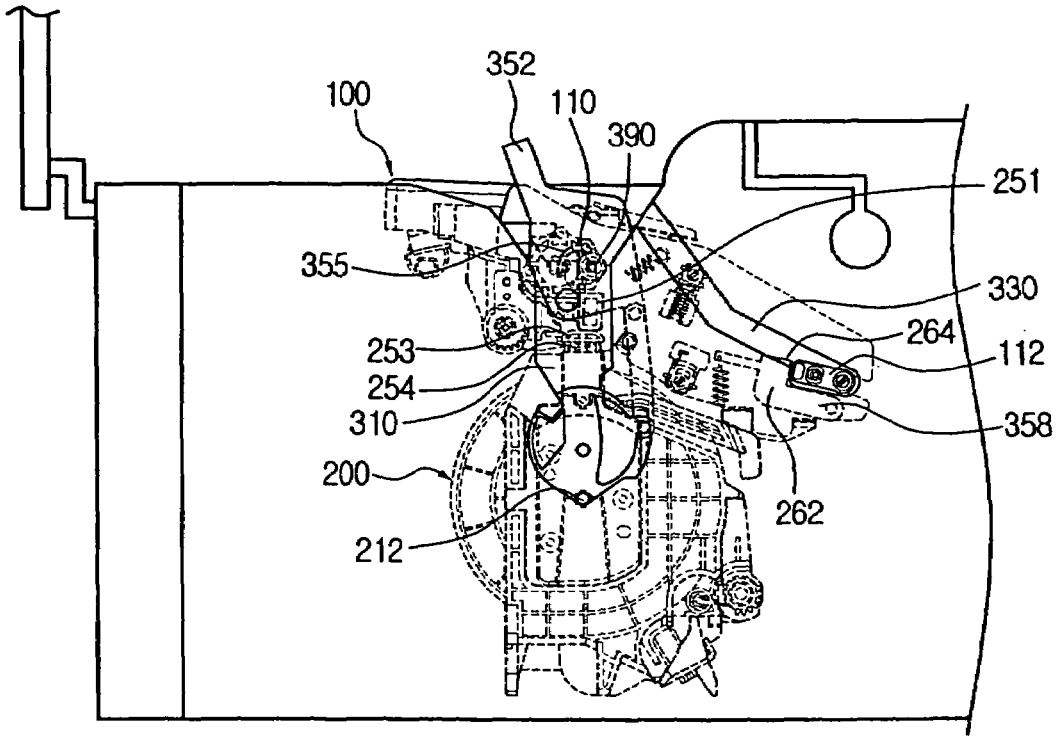
FIG. 7 is a partial cross-sectional view showing the transfer unit mounting device as shown in FIG. 3, in which the housing protrusion contacts a bumper bar, and a first guide protrusion is seated in a seating portion of a first guide rail.

After that, as shown in FIG. 7, the first guide protrusion 110 can be seated in a seating portion 390 of the first guide rail 310. At this time, the housing protrusion 251 of the damping unit 250 can be brought into contact with the buffer bar 253 of the damper assembly 252 disposed on the developing unit 200, thereby supporting the weight of the transfer unit 100 using the elastic member 254. The second guide protrusion 112 can slide along the first surface 264 of the interference lever 358 and can pass over the free end 262 of the interference lever 358 to be seated in a mounting position of the second guide rail 330 as shown in FIG. 7.

Figure 8:
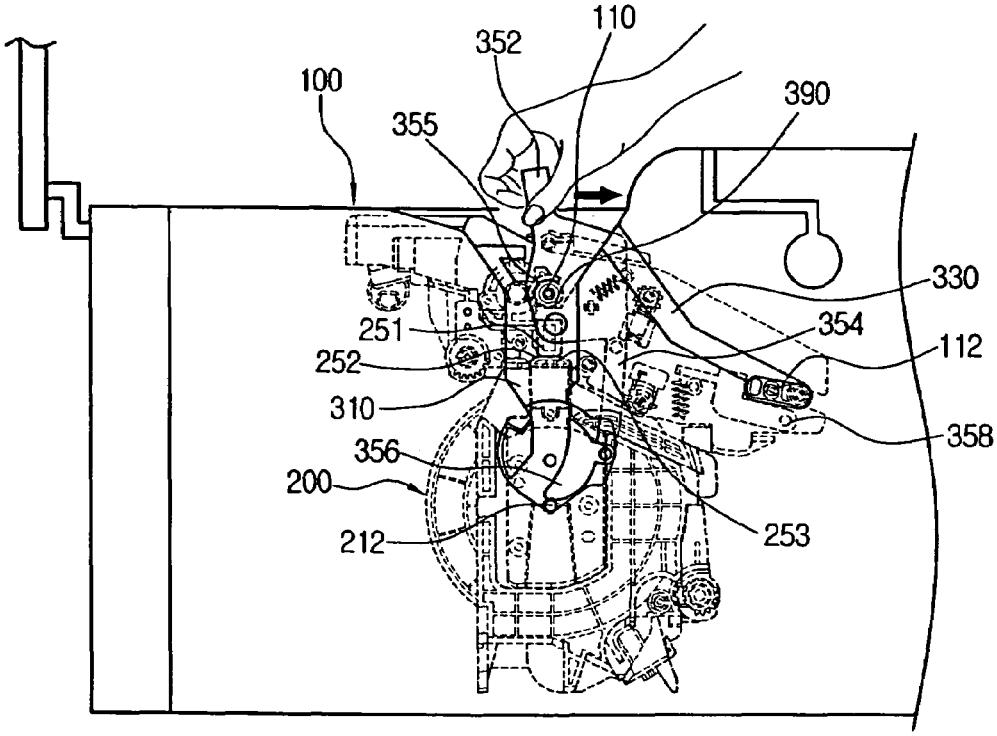
FIG. 8 is a partial cross-sectional view showing the transfer unit mounting device as shown in FIG. 3, in which the first guide protrusion of the transfer unit and a shaft of the developing unit are fixed by coupled by the pulling of a rotary lever.

After that, as shown in FIG. 8, when the user rotates the rotary lever 352 in an arrowed direction from an original position to a locking position, the rotary lever 352 can move the connection bar 354 substantially in a vertical direction, and the connection bar 354 can rotate the rotary cam 356 in a clockwise direction. As the rotary lever 352 rotates, the cover 355 of the rotary lever 352 covers the first guide protrusion 110 of the transfer unit 100 to prevent the first guide protrusion 110 from deviating upwardly from a seating position 340, and simultaneously, the rotary cam 356 can in the clockwise direction to press the OPC drum shaft 212 to fix the OPC drum shaft 212. Accordingly, as long as the rotary lever 352 is not recovered (returned) to the original position, the first and the second guide protrusions 110 and 120 can be prevented by the locking unit 350 from escaping and can be retained in a stable state. Also, since the gap ring 120 provided on the nip roller 122 of the transfer unit 100 comes into contact with both sides of the photosensitive drum 210 of the developing unit 200, the gap between the transfer belt (not shown) and the photosensitive drum 200 can be maintained constant even if the first guide protrusion 110 is press-fitted into the first guide rail 310 by the rotary lever 352.

In order to separate the transfer unit 100 from the image forming apparatus, the user opens the body cover 382 of the image forming apparatus, recovers (rotates) the rotary lever 352 to the original position, lifts the second guide protrusion 112 from the second guide rail 330 a little bit, separates the transfer unit 100 and the developing unit 200 from each other, and then draws out the transfer unit 100 in a reverse order of mounting the transfer unit 100.

Figure 9:
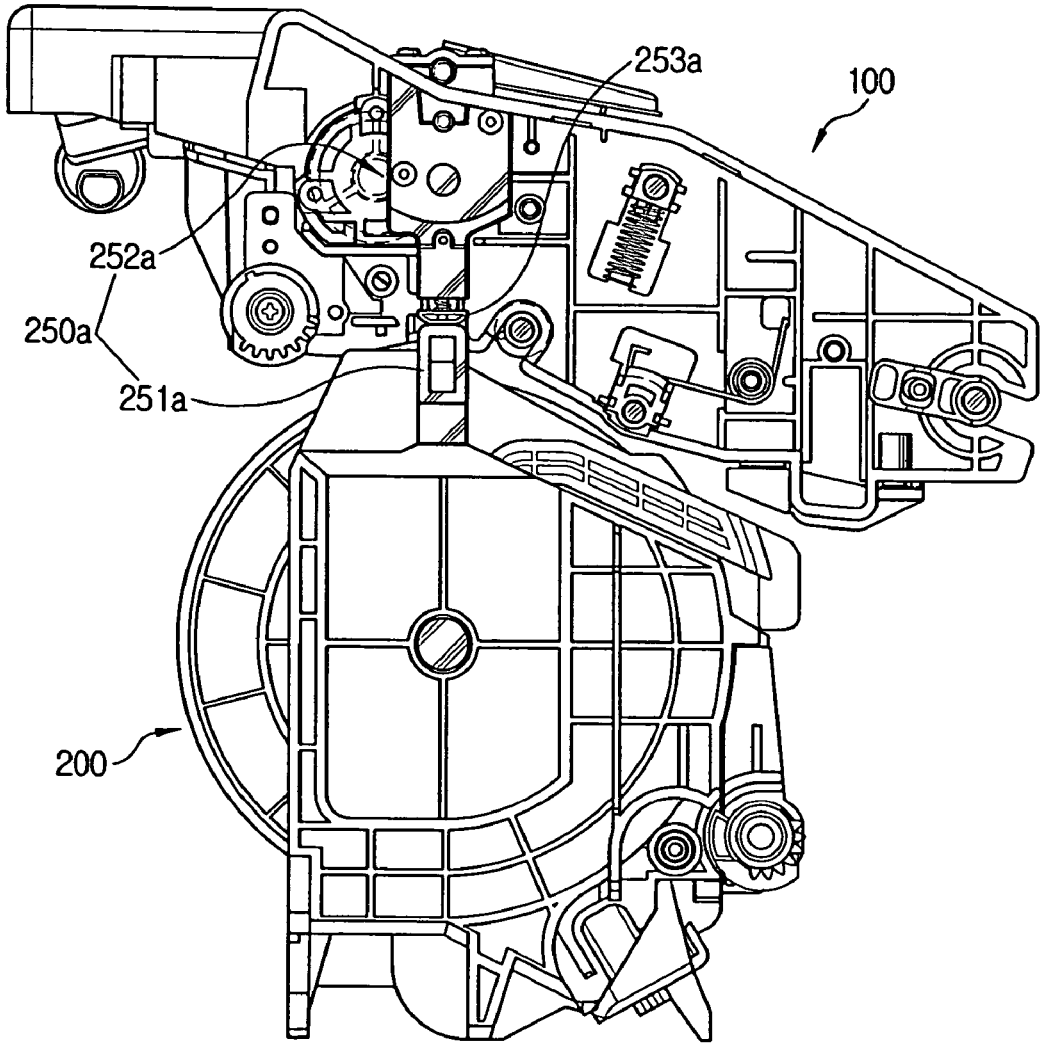
FIG. 9 is a partial cross-sectional view showing a transfer unit mounting device according to another embodiment of the present general inventive concept.

FIG. 9 shows a transfer unit mounting device according to another embodiment of the present general inventive concept. As shown in FIG. 9, the transfer unit mounting device may be identical to that of the above-described embodiment of FIGS. 3-8 except for an installing position of a damper assembly 252*a*, which constitutes a damping unit 250*a* with a housing protrusion 251*a*. Therefore, detailed descriptions of identical parts are omitted for the conciseness.

Referring to FIG. 9, the damper assemblies 252*a* can be disposed on both sides of a housing of a transfer unit 100, and the housing protrusions 251*a* can be disposed on both sides of a housing of a developing unit 200. Accordingly, a shock caused by the collision of the transfer unit 100 with the developing unit 200 during the mounting of the transfer unit 100 when a buffer bar 253*a* of the damper assembly 252*a* contacts with the housing protrusion 251*a*, can be mitigated by the same operation as described above with reference to FIGS. 3-8.

Figure 10:
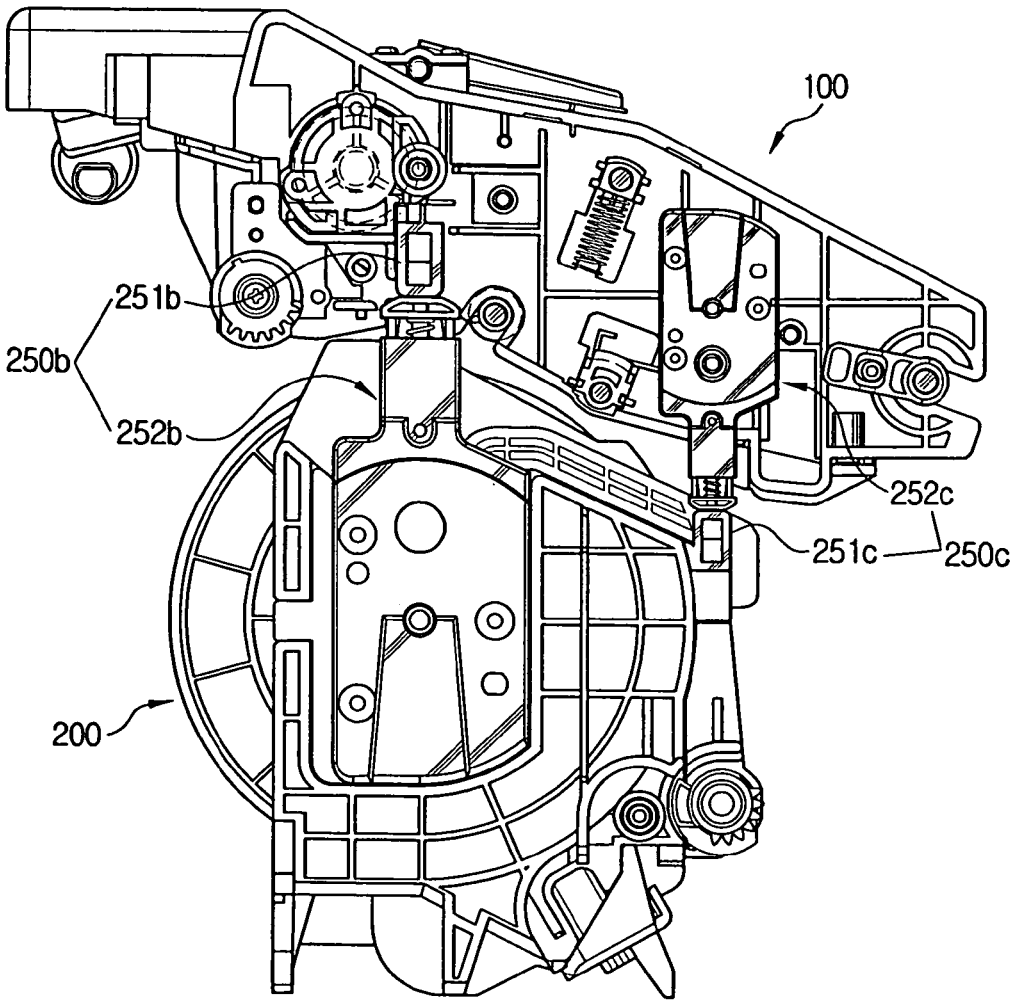
FIG. 10 is a partial cross-sectional view showing a transfer unit mounting device according to another embodiment of the present general inventive concept.

FIG. 10 shows a transfer unit mounting device according to another embodiment of the present general inventive concept. This embodiment differs from the preceding embodiments of FIGS. 3-8 and 9 in that there are two damping units 250*b* and 250*c*. The transfer unit mounting device may have a first damping unit 250*b* and a second damping unit 250*c* as shown in FIG. 10. The first damping unit 250*b* may include first housing protrusions 251*b* disposed on both side surfaces of a housing of a transfer unit 100 and first damper assemblies 252*b* disposed on both side surfaces of a housing of a developing unit 200. Also, the second damping unit 250*c* includes second damper assemblies 252*c* disposed on both side surfaces of the housing of the transfer unit 100 and second housing protrusions 251*c* disposed on both side surfaces of the housing of the developing unit 200.

The transfer unit mounting device according to this embodiment of the present general inventive concept accomplishes a buffering operation by bringing the first damper assembly 252*b* into contact with the first housing protrusion 251*b* and also bringing the second damper assembly 252*c* into contact with the second housing protrusion 251*c*. As a result, the transfer unit mounting device can doubly absorb a shock during the mounting of the transfer unit 100.

Although a few exemplary embodiments have been described above, the present invention is not limited to the above embodiments only. A plurality of damper assemblies may be disposed on a developing unit, and a plurality of housing protrusions may be disposed on a transfer unit. In an alternative example, a plurality of damper assemblies may be disposed on a transfer unit, and a plurality of housing protrusions may be disposed on a developing unit. A damper assembly can be mounted on a frame or a body of the image forming apparatus to elastically support one of the transfer unit and the developing unit.

The transfer unit mounting device as described above can maintain substantially a constant gap between the developing unit 200 and the transfer unit 100 by simply rotating the rotary lever 352 after the first and the second guide protrusions 110 and 120 are inserted and pushed into the first and the second guide rails 310 and 330, respectively. Accordingly, there is an advantage of easy mounting and dismounting of the transfer unit in and from the image forming apparatus.

Additionally, since the damping unit 250 absorbs a shock exerted on the transfer unit 110 and the developing unit 200, a lifespan of the transfer unit 100 or the developing unit 200 can be extended, and the possibility of having a disorder system can be avoided.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A transfer unit mounting device of an image forming apparatus to mount and dismount a transfer unit in and from the image forming apparatus, comprising:

a transfer unit having a transfer belt driven by a plurality of rollers and a housing to protect the transfer belt; and at least one damping unit to elastically support the transfer unit to mitigate a shock exerted on the transfer unit when the transfer unit is mounted in the image forming apparatus, and having at least one housing protrusion disposed on a photoconductive unit of the image forming apparatus and a damper assembly disposed on the transfer unit.

2. The transfer unit mounting device as claimed in claim 1, wherein the image forming apparatus comprises a photoconductive unit, the damping unit comprises:

at least one housing protrusion disposed on the housing; and a damper assembly disposed on the photoconductive unit of the image forming apparatus, to buffer and support a weight of the transfer unit when the damper assembly becomes in contact with the housing protrusion.

3. The transfer unit mounting device as claimed in claim 1, wherein the damper assembly is disposed on the transfer unit to buffer and support a weight of the transfer unit when the damper assembly becomes in contact with the housing protrusion.

4. The transfer unit mounting device as claimed in claim 1, wherein the image forming apparatus comprises a developing unit, and the at least one damping unit comprises first and second damper assemblies respectively disposed on the housing of the transfer unit and the developing unit of the image forming apparatus.

5. The transfer unit mounting device as claimed in claim 2, wherein the damper assembly comprises:

an elastic member;

a buffer bar elastically movable by the elastic member in a vertical direction; and a supporting member to enclose and support the elastic member and the buffer bar.

6. The transfer unit mounting device as claimed in claim 3, wherein the damper assembly comprises:

an elastic member;

a buffer bar elastically movable by the elastic member in a vertical direction; and a supporting member to enclose and support the elastic member and the buffer bar.

7. The transfer unit mounting device as claimed in claim 4, wherein the damper assembly comprises:

an elastic member;

a buffer bar elastically movable by the elastic member in a vertical direction; and a supporting member to enclose and support the elastic member and the buffer bar.

8. The transfer unit mounting device as claimed in claim 1, wherein the image forming apparatus comprises a photosensitive drum, and the at least one damping unit comprises a gap ring to maintain substantially a constant gap between the transfer belt and a photosensitive drum on which an image to be printed is formed.

9. The transfer unit mounting device as claimed in claim 1, further comprising:

at least one guide protrusion disposed on the transfer unit; and at least one guide rail disposed in a body of the image forming apparatus to guide the guide protrusion.

10. The transfer unit mounting device as claimed in claim 9, wherein the at least one guide protrusion comprises at least one first guide protrusion and at least one second guide protrusion, and the at least one guide rail comprises at least one first guide rail and at least one second guide rail to correspond to the at least one first guide protrusion and the at least one second guide protrusion, respectively.

11. The transfer unit mounting device as claimed in claim 10, further comprising a locking unit to secure the first and the second guide protrusions in a secured position so that the first and second guide protrusions cannot be moved and released from the secured position.

12. The transfer unit mounting device as claimed in claim 11, wherein the locking unit comprises:

a rotary lever to secure the first guide protrusion;

a rotary cam to secure the developing unit;

a connection bar to connect the rotary lever and the rotary cam so that the rotary lever and rotary cam can move in relation to each other; and an interference lever to limit a movement of the second guide protrusion.

13. An image forming apparatus, comprising:

a paper feeding device to convey paper;

a photoconductive unit where an image is formed through a light scanning procedure and a developing procedure;

a transfer unit having a transfer belt driven by a plurality of rollers and a housing to protect the transfer belt to transfer the image formed on the photoconductive unit to a printing medium;

a fusing unit to affix a toner onto the printing medium; and a transfer unit mounting device having at least one damping unit to mitigate a shock exerted on the transfer unit when the transfer unit is mounted on the image forming apparatus above the photoconductive unit, the damping unit having at least one housing protrusion disposed on the photoconductive unit of the image forming apparatus and a damper assembly disposed on the transfer unit.

14. The image forming apparatus as claimed in claim 13, wherein the transfer unit mounting device further comprises a gap ring to maintain a substantially constant gap between the transfer unit and the photoconductive unit.

15. The image forming apparatus as claimed in claim 13, wherein one of the transfer unit and the photoconductive unit comprises a housing, and the damping unit comprises:

at least one housing protrusion disposed on the housing; and a damper assembly to buffer and support a weight of the transfer unit when the damper assembly becomes in contact with the at least one housing protrusion, and the damper assembly having an elastic member, a buffer bar elastically movable by the elastic member in a vertical direction, and a supporting member to enclose and support the elastic member and the buffer bar.

16. The image forming apparatus as claimed in claim 13, further comprising:

at least one guide protrusion disposed on the transfer unit; and at least one guide rail disposed in a body of the image forming apparatus to guide the guide protrusion.

17. The image forming apparatus as claimed in claim 16, further comprising:

a locking unit to secure the at least one guide protrusion in a secured position so that the first and second guide protrusions cannot be moved and released from the secured position.

18. A transfer unit mounting device used with an image forming apparatus to mount a transfer unit and a developing unit in a body thereof, comprising:

a damping unit disposed on one of a developing unit, a transfer unit having a transfer belt driven by a plurality of rollers and a housing to protect the transfer belt, and a body of an image forming apparatus to mitigate a shock generated between the developing unit and the transfer unit exerted on the one of the developing unit, the transfer unit, and the body of the image forming apparatus when the transfer unit is mounted above the developing unit, the damping unit having at least one housing protrusion disposed on a photoconductive unit of the image forming apparatus and a damper assembly disposed on the transfer unit.

19. The transfer unit mounting device as claimed in claim 18, wherein the transfer unit and the developing unit are mounted in the body of the image forming apparatus in a direction, and the shock is generated in the direction when the transfer unit and the developing unit contact each other.

20. The transfer unit mounting device as claimed in claim 18, wherein the transfer unit and the developing unit are mounted in the body of the image forming apparatus in a direction, and the shock is generated when the transfer unit and the developing unit contact each other in the direction.

21. The transfer unit mounting device as claimed in claim 18, wherein the one of the transfer unit, the developing unit, and the body comprises a sidewall substantially perpendicular to a rotation axis of the photosensitive drum, and the damping unit is mounted on the sidewall.

22. The transfer unit mounting device as claimed in claim 18, wherein the one of the transfer unit, the developing unit, and the body comprises a sidewall, and the damping unit comprises a first and a second damping units formed on the sidewall.

23. The transfer unit mounting device as claimed in claim 18, wherein the transfer unit, the developing unit, and the body each comprise a sidewall, and the damping unit comprises a first damping unit disposed on the sidewall of the one of the transfer unit, the developing unit, and the body, and a second damping unit formed on the sidewall of another one of the transfer unit, the developing unit, and the body.

24. The transfer unit mounting device as claimed in claim 18, wherein the damping unit comprises a damper assembly disposed on the one of the transfer unit, the developing unit, and the body, and a protrusion disposed on another one of the transfer unit, the developing unit, and the body.

25. The transfer unit mounting device as claimed in claim 18, wherein the damping unit comprises a first damping unit disposed on the one of the transfer unit, the developing unit, and the body, and a second damping unit disposed on another one of the transfer unit, the developing unit, and the body.

26. The transfer unit mounting device as claimed in claim 18, wherein the damping unit comprises first and second damper assemblies and first and second protrusions to correspond to the first and second damper assemblies, and the first damper assembly and the first protrusion are disposed on the one of the transfer unit, the developing unit, and the body while the second damper assembly and the second protrusion are disposed on another one of the transfer unit, the developing unit, and the body.

27. The transfer unit mounting device as claimed in claim 18, wherein the damping unit comprises first and second damper assemblies and first and second protrusions to correspond to the first and second damper assemblies, and the first damper assembly and the second protrusion are disposed on the one of the transfer unit, the developing unit, and the body while the second damper assembly and the first protrusion are disposed on another one of the transfer unit, the developing unit, and the body.

28. The transfer unit mounting device as claimed in claim 18, wherein the damping unit comprises first and second damping units disposed on opposite side of the one of the transfer unit, the developing unit, and the body.

29. The transfer unit mounting device as claimed in claim 28, wherein the first and second damping units are disposed on a line substantially parallel to a rotation axis of the developing unit and the transfer unit.

30. The transfer unit mounting device as claimed in claim 18, wherein the damping unit comprises first and second damping units disposed on the same side of the one of the transfer unit, the developing unit, and the body.

31. The transfer unit mounting device as claimed in claim 18, wherein the one of the transfer unit, the developing unit, and the body comprises a sidewall, and the damping unit comprises first and second damping units both disposed on the same sidewall of the one of the transfer unit, the developing unit, and the body.

32. The transfer unit mounting device as claimed in claim 18, wherein the transfer unit comprises the transfer belt, and the first and second damping units are disposed at opposite positions with respect to a nip formed between the transfer belt and the photosensitive drum.

33. The transfer unit mounting device as claimed in claim 18, wherein the damping unit comprises:

a buffer bar to be elastically biased toward another one of the transfer unit, the developing unit, and the body to receive the shock.

34. The transfer unit mounting device as claimed in claim 33, wherein the buffer bar moves in a direction substantially perpendicular to a rotation axis of the photosensitive drum of the developing unit.

35. The transfer unit mounting device as claimed in claim 33, wherein the transfer unit comprises the transfer belt and a roller to rotate the transfer belt, and the buffer bar moves in a direction substantially perpendicular to a rotation axis of the roller of the transfer unit.

36. The transfer unit mounting device as claimed in claim 33, wherein the damping unit further comprises:

a fixing part to be fixedly coupled to the one of the transfer unit, the developing unit, and the body; and an elastic member disposed in the fixing part to bias the buffer bar in a radial direction of a rotation axis of the photosensitive drum on the developing unit.

37. The transfer unit mounting device as claimed in claim 19, wherein the body of the image forming apparatus comprises a first guide rail and a second guide rail, and the developing unit is mounted in the body along the first guide rail while the transfer unit is mounted in the body along the first guide rail in the direction and along the second guide rail in a second direction.

38. The transfer unit mounting device as claimed in claim 37, wherein the direction is a radial direction of a rotation axis of the photosensitive drum of the developing unit.

39. The transfer unit mounting device as claimed in claim 37, wherein the damping unit receives the shock in the direction.

40. The transfer unit mounting device as claimed in claim 37, wherein the first and second guide rails comprises a common guide portion through which the transfer unit and the developing unit are mounted.

41. The transfer unit mounting device as claimed in claim 37, wherein the common guide porting is disposed in a radial direction of a rotation axis of the photosensitive drum of the developing unit.

42. The transfer unit mounting device as claimed in claim 18, wherein the transfer unit further comprises:

a lock unit having a single lever to simultaneously lock the transfer unit and the developing unit in the body.

43. An image forming apparatus having a transfer unit mounting device to mount and dismount a transfer unit onto and off of a developing unit in a frame of the image forming apparatus, the transfer unit transferring a toner image from the developing unit to a medium, the transfer unit mounting device comprising:

a transfer unit having a transfer belt driven by a plurality of rollers and a housing to protect the transfer belt; and at least one damping unit to elastically support the transfer unit to mitigate a shock exerted on the transfer unit when the transfer unit is mounted on the developing unit in the frame, the damping unit having at least one housing protrusion disposed on a photoconductive unit of the image forming apparatus and a damper assembly disposed on the transfer unit.

44. An image forming apparatus having a transfer unit mounting device to mount and dismount a transfer unit in and from the image forming apparatus, the transfer unit mounting device comprising:

a transfer unit having a transfer belt driven by a plurality of rollers and a housing to protect the transfer belt;

at least one damping unit to elastically support the transfer unit to mitigate a shock exerted on the transfer unit when the transfer unit is mounted, the dampening unit having at least one housing protrusion disposed on a photoconductive unit of the image forming apparatus and a damper assembly disposed on the transfer unit; and a locking unit to lock the transfer unit into place in the image forming apparatus.

45. An image forming apparatus having a transfer unit mounting device to mount and dismount a transfer unit in and from the image forming apparatus, the transfer unit mounting device comprising:

a transfer unit having a transfer belt driven by a plurality of rollers and a housing to protect the transfer belt;

at least one damping unit to elastically support the transfer unit to prevent a shock from being transferred to the transfer unit when the transfer unit is mounted, the dampening unit having at least one housing protrusion disposed on a photoconductive unit of the image forming apparatus, and a damper assembly disposed on the transfer unit; and a gap ring to maintain a substantially-constant gap between the transfer unit and a photoconductive unit in the image forming apparatus.

* * * * *